United States Patent [19]

White et al.

[11] Patent Number: 4,583,801

[45] Date of Patent: Apr. 22, 1986

[54] CIRCUIT BOARD COMPOSITE CONNECTORS

[75] Inventors: Cyril J. White, Chandlers Ford; Christopher Joyce, Southampton, both of England

[73] Assignee: BICC public limited company, London, England

[21] Appl. No.: 548,738

[22] Filed: Nov. 4, 1983

[30] Foreign Application Priority Data

Nov. 5, 1982 [GB] United Kingdom ..... 8231714

[51] Int. Cl.[4] ..... H01R 4/24; H01R 43/20; H01R 13/187

[52] U.S. Cl. ..... 339/17 C; 29/884; 339/97 R; 339/258 R; 339/276 SF

[58] Field of Search ..... 339/17 C, 17 R, 17 P, 339/97 R, 98, 99 R, 276 SF, 217 R, 221 M, 221 R, 258 R, 258 P; 29/876, 882, 884

[56] References Cited

U.S. PATENT DOCUMENTS 3,286,220 11/1966 Marley et al. ..... 339/258 P X
3,504,328 3/1970 Olsson ..... 339/17 C
3,858,153 12/1974 Coller et al. ..... 339/17 C
4,381,132 4/1983 Tournier ..... 339/99 R

FOREIGN PATENT DOCUMENTS 2083958 3/1982 United Kingdom ..... 339/258 R

*Primary Examiner*—Gil Weidenfeld
*Assistant Examiner*—Steven C. Bishop
*Attorney, Agent, or Firm*—Buell, Ziesenheim, Beck & Alstadt

[57] ABSTRACT

In a bandoleer of composite insulation displacement connectors, the tubular end portion of each composite connector incorporating diametrically opposed bifurcated insulation displacement contacts is joined to a side edge of a metal strip by a fracturable link so folded out of the plane of the strip that the common axis of the slots of the bifurcated contacts lies at an acute angle to the longitudinal axis of the strip. This acute angle is such that, when composite connectors are fitted into adjacent holes in a circuit board, the positions of the bifurcated contacts of each composite connector are such that a length of insulated conductor introduced between the limbs of the bifurcated contacts of the composite connector will extend between neighboring composite connectors with negligible risk of rendering difficult connection of a length of insulated conductor to a neighboring composite connector.

10 Claims, 4 Drawing Figures

Fig.1.
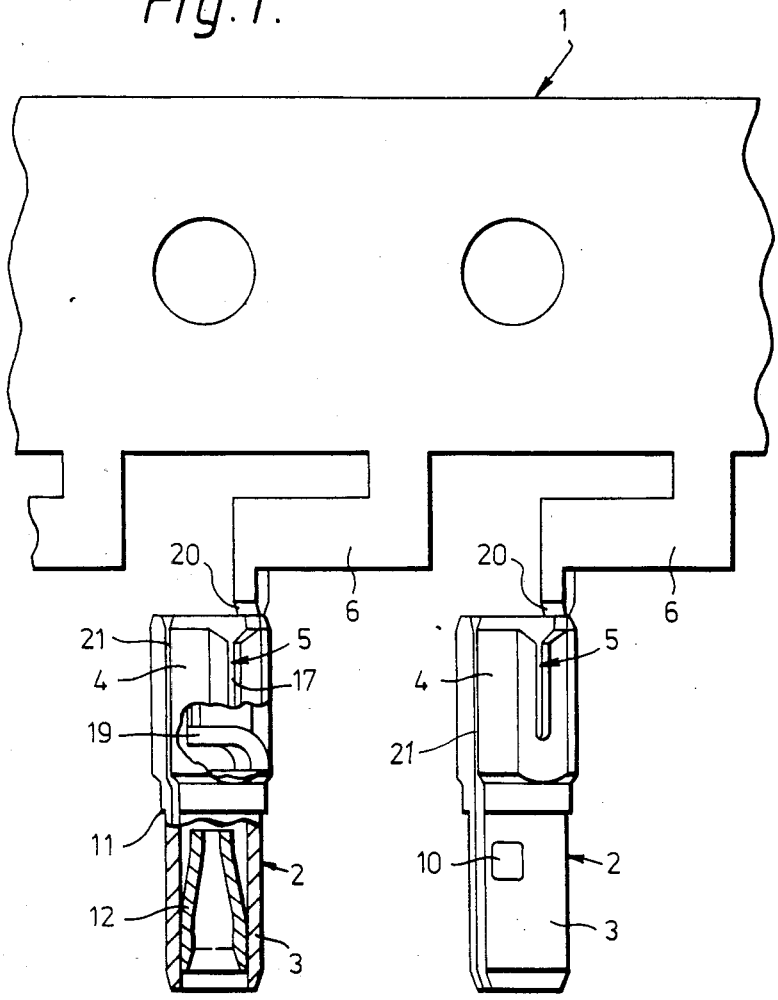
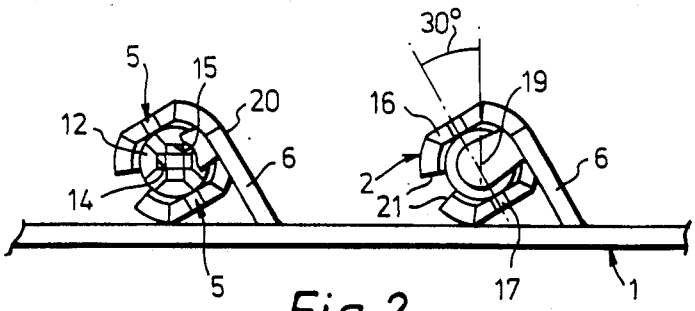
Fig.2.

CIRCUIT BOARD COMPOSITE CONNECTORS

This invention relates to composite connectors for use with circuit boards.

One kind of circuit board that is in general use comprises a board of electrically insulating material, which board has bonded on one of its surfaces a regular pattern of strips of electrically conductive metal or metal alloy, usually but not necessarily copper, and has, extending through the board and the overlying electrically conductive metal strips, a multiplicity of holes distributed at spaced positions along the strips. Circuit boards of this kind will hereinafter, for convenience, be referred to as "a circuit board of the kind described".

It is common practice to provide miniature electric connectors and terminals in the form of strips of electrically conductive sheet metal or metal alloy having integral with and at spaced positions along a longitudinally extending edge of a strip a multiplicity of laterally extending connectors or terminals, each of which is formed from a preform of said sheet metal or metal alloy. Such strips of miniature electric connectors or terminals are generally and, for convenience, will hereinafter be referred to as "bandoleers".

It is an object of the present invention to provide, for use with circuit boards of the kind described, an improved bandoleer of composite connectors from which composite connectors can be readily fractured and rapidly and simply fitted into holes in a circuit board.

According to the invention, the improved bandoleer of composite connectors comprises an elongate strip of electrically conductive sheet metal or metal alloy having integral with and at spaced positions along at least one of its longitudinally extending edges a multiplicity of composite connectors extending laterally from the strip, each of which composite connectors is formed from a preform of said sheet metal or metal alloy folded or otherwise shaped to form, at that end of the composite connector remote from said longitudinally extending edge, a socket which will make a fit in a hole in a circuit board and in which a terminal pin of a circuit component can be resiliently gripped and, at that end of the composite connector integral with said longitudinally extending edge, a tubular end portion of substantially circular cross-section including two bifurcated contacts which are at substantially diametrically opposed positions with the slots bounded by the limbs of the bifurcated contacts opening into said end of the composite connector and which are of such a form that when a length of insulated wire is introduced between the limbs of the bifurcated contacts, the limbs will displace the insulating covering of the wire to effect an electrical connection with the wire at at least two positions spaced along its length, the tubular end portion of each composite connector being joined to said longitudinally extending edge of the strip by a fracturable link so folded out of the plane of the elongate strip that the common axis of the slots bounded by the limbs of the bifurcated contacts lies at an acute angle to the longitudinal axis of the strip, which acute angle is such that, when composite connectors are fitted into adjacent holes in a circuit board, the positions of the bifurcated contacts of each composite connector are such that a length of insulated conductor introduced between the limbs of the bifurcated contacts of the composite connector will extend between neighbouring composite connectors with negligible risk of preventing or rendering difficult connection of a length of insulated conductor to a neighbouring composite connector.

The improved bandoleer of composite connectors permits composite connectors of the bandoleer to be fitted into holes in a circuit board of the kind described with the common axes of the slots of the bifurcated contacts of the connectors substantially parallel to one another and orientated to facilitate ready introduction into the slots of insulated conductors, either by introducing successive connectors into holes in a circuit board from a bandoleer using an automatically-operated machine or by concurrently introducing a plurality of connectors, e.g. ten connectors, into holes in a circuit board from a limited length of bandoleer using a hand-operated punch, a hammer or other hand-operated device.

Preferably, to facilitate manufacture of the bandoleer, the distance between the longitudinal axes of adjacent composite connectors of the bandoleer is twice the distance between adjacent holes of a circuit board that are closest together. Thus, for any row of such holes in a circuit board, whilst an automatically-operated machine can be used to introduce successive composite connectors of a bandoleer into successive holes of the row, in each of the other methods above described, a composite connector of a limited length of bandoleer will be introduced into every other hole in the row so that two passes along the row will be necessary to fit composite connectors in all the holes.

Where, as is general practice, the distance between at least some adjacent holes in a circuit board of the kind described is approximately 2.54 mm (0.1 inch) and, as is preferred, the overall diameter of the tubular end portion of each composite connector is approximately 1.95 mm, preferably the fracturable link is so inclined to the plane of the elongate strip that the common axis of the slots bounded by the limbs of the bifurcated contacts of each composite connector lies at an acute angle to the longitudinal axis of the strip lying in the range 60° to 65°. In a preferred embodiment, the common axis of the slots bounded by the limbs of the bifurcated contacts of each composite connector lies at an angle of 60° to the longitudinal axis of the elongate strip.

Each fracturable link joins the tubular end portion of its associated composite connector preferably at a position between the bifurcated contacts and substantially diametrically opposite the longitudinally extending free edges of the preform of which the composite connector is formed, which free edges abut or are spaced a short distance apart. In a preferred embodiment, each fracturable link is of approximately Z- or S-shape and is designed to fracture at a position immediately adjacent the tubular end portion of its associated composite connector.

For resiliently gripping a terminal pin of a circuit component, the socket of each composite connector may have fitted therein a separately formed socket contact of a metal or metal alloy of high electrical conductivity or it may have resilient contact means integral with that part of the preform forming the socket. The integral resilient contact means may be a single resilient tongue which is folded radially inwardly from a window in the wall of the socket to such an extent that a terminal pin of a circuit component can be resiliently gripped between the tongue and a part of the wall of the socket substantially diametrically opposite the tongue, or it may be a pair of diametrically opposed resilient tongues which are folded radially inwardly from windows in the wall of the socket and between which a terminal pin of a circuit component can be resiliently gripped. Preferably the separately formed socket contact includes a pair of substantially diametrically opposed substantially flat contact surfaces or the or each integral resilient tongue has a substantially flat contact surface which, to facilitate introduction of a terminal pin of substantially rectangular transverse cross-section, preferably lie or lies in planes or a plane that are or is substantially parallel to the major surfaces of the strip. Such an arrangement ensures that the terminal pins of separate circuit components can be introduced into the sockets of immediately adjacent composite connectors mounted in a circuit board. The separately formed socket contact may also include a second pair of substantially diametrically opposed substantially flat contact surfaces which are substantially normal to the first pair of diametrically opposed flat contact surfaces.

Preferably, the opposed faces of the limbs of each bifurcated contact of each composite connector over at least a part of their lengths near the closed end of the slot bounded by the limbs and over at least a part of their widths are substantially flat and lie substantially parallel to the plane common to the axes of the bifurcated contacts and of the composite connector or they may lie in planes which converge in a direction towards the axis of the composite connector. Preferably, also, the radially inner and outer surfaces of the limbs of the bifurcated contacts of each composite connector are substantially flat and these surfaces preferably lie in planes substantially normal to said common plane.

Each composite connector may also include any one or more of the optional features of the composite connector described and claimed in the specification of co-pending British Patent Application No. 8127769 of Vero Electronics Limited.

The invention is further illustrated by a description, by way of example, of the preferred bandoleer of composite connectors with reference to the accompanying drawings, in which:

FIG. 1 is a fragmental plan view of the bandoleer, one composite connector being shown partly in section and partly in elevation;

FIG. 2 is a side view of the part of the bandoleer shown in FIG. 1 with the stop in one composite connector cut away to expose the separately formed socket contact;

Figure 3:
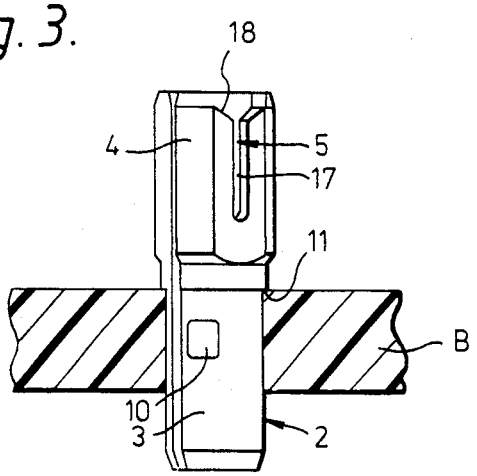
FIG. 3 is a side view, partly in section and partly in elevation, of a composite connector fitted in a hole in a circuit board of the kind described.

Referring to FIGS. 1 to 3, the preferred bandoleer of composite connectors comprises an elongate strip 1 of sheet copper, having integral with and at spaced positions along one of its longitudinally extending edges a multiplicity of composite connectors 2 extending laterally from the strip. Each composite connector 2 is formed from a preform of the sheet copper folded to form, at that end of the composite connector remote from the longitudinally extending edge of the strip 1, a socket 3 which will make a fit in a hole in a circuit board and, at that end of the composite connector integral with the longitudinally extending edge, a tubular end portion 4 of substantially circular cross-section including two bifurcated contacts 5 which are at diametrically opposed positions. The tubular end portion 4 of each composite connector 2 is joined to the longitudinally extending edge of the strip by a fracturable link 6 of approximately Z-shape.

In each composite connector 2, the socket 3 has an outwardly projecting dimple 10 for effecting a snap fit in a hole in a circuit board and, between the socket and the tubular end portion, the connector has an outwardly extending shoulder 11 for limiting the extent to which the connector can be inserted into a hole in a circuit board. Tightly fitting within the socket 3 is a separately formed gold-plated copper socket contact 12 which has, for resiliently gripping a pin of rectangular transverse cross-section of a circuit component, two pairs of diametrically opposed flat contact surfaces, the contact surfaces of one pair 14 lying normal to the contact surfaces of the other pair 15 and the contact surfaces of the pair 15 lying in planes parallel to the major surfaces of the strip. The slots 17 bounded by the limbs 16 of the bifurcated contacts 5 open into the end of the composite connector nearer the longitudinally extending edge of the strip 1 and the opposed faces of the limbs of each bifurcated contact over an intermediate major part of their width are flat and lie parallel to the plane common to the axes of the bifurcated contacts and of the composite connector. The radially inner and outer surfaces of the limbs 16 of the bifurcated contacts 5 are also flat and lie in planes normal to said common plane. The corners of the limbs 16 of each bifurcated contact 5 are radiused and at the open end of each bifurcated contact, parts of the limbs are removed to provide a throat 18 to facilitate introduction of a length of insulated wire into the slot 17. In the wall of the tubular end portion connector 4 is a window from which is inwardly folded a tongue 19 constituting a stop limiting the extent to which a pin of a circuit component can be inserted into the socket 3. When a length of insulated wire is introduced between the limbs 16 of the bifurcated contacts 5 of the composite connector, the limbs will displace the insulating covering of the wire to effect an electrical connection with the wire at two positions spaced along its length.

The fracturable link 6 between the strip 1 and each composite connector 2 is so folded out of the plane of the elongate strip 1 that the common axis of the slots 17 bounded by the limbs 16 of the bifurcated contacts 5 lies at an acute angle of 60° to the longitudinal axis of the strip. Each fracturable link 6 joins the tubular end portion 4 of its associated composite connector 2 at a position 20 between the bifurcated contacts 5 and diametrically opposite the longitudinally extending free edges 21 of the preform of which the composite connector is formed, which free edges are spaced a short distance apart, and the fracturable link is designed to fracture immediately adjacent the tubular end portion.

To facilitate manufacture of the bandoleer, the distance between the longitudinal axes of adjacent composite connectors 2 is approximately 5.08 mm (0.2 inch), which distance is twice the distance between adjacent holes of a circuit board, the overall diameter of the tubular end portion 4 of each composite connector being approximately 1.95 mm.

Figure 4:
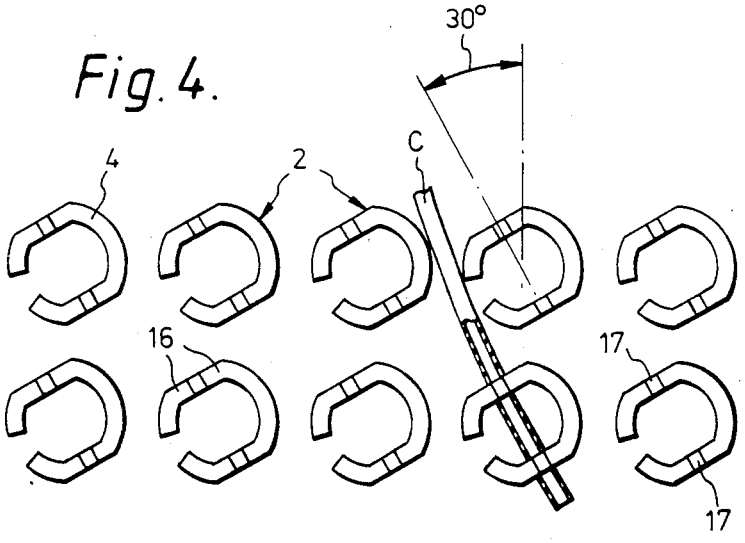
FIG. 4 is a diagrammatic fragmental plan view of the matrix of holes of a circuit board with composite connectors fitted therein showing the relative inclinations of the common axes of the bifurcated contacts of the connectors.

As will be seen on referring to FIG. 4, when composite connectors 2 of the bandoleer are fitted into adjacent holes in a circuit board B, the positions of the bifurcated contacts 5 of each composite connector are such that a length of insulated conductor C introduced between the limbs 16 of the bifurcated contacts of the composite connector will extend between neighbouring composite connectors with negligible risk of preventing or rendering difficult connection of a length of insulated conductor to a neighbouring composite connector.

What we claim as our invention is:

1. For use with circuit boards of the kind comprising a board of electrically insulating material, a regular pattern of strips of electrically conductive metal or metal alloy bonded on one surface of the board and, extending through the board and the overlying electrically conductive metal strips, a multiplicity of holes distributed at spaced positions along the strips, a bandoleer of composite connectors comprising an elongate strip of electrically conductive sheet metal or metal alloy having integral with and at spaced positions along at least one of its longitudinally extending edges a multiplicity of composite connectors extending laterally from the strip, each of which composite connectors is formed from a preform of said sheet metal or metal alloy shaped to form, at that end of the composite connector remote from said longitudinally extending edge, a socket which will make a fit in a hole in a circuit board and in which a terminal pin of a circuit component can be resiliently gripped and, at that end of the composite connector integral with said longitudinally extending edge, a tubular end portion of substantially circular cross-section including two bifurcated contacts which are at substantially diametrically opposed positions with the slots bounded by the limbs of the bifurcated contacts opening into said end of the composite connector and which are of such a form that when a length of insulated wire is introduced between the limbs of the bifurcated contacts, the limbs will displace the insulating covering of the wire to effect an electrical connection with the wire at at least two positions spaced along its length, the tubular end portion of each composite connector being joined to said longitudinally extending edge of the strip by a fracturable link so folded out of the plane of the elongate strip that each of the fracturable link and the common axis of the slots bounded by the limbs of the bifurcated contacts lies at an acute angle to the longitudinal axis of the strip, which acute angle is such that, when composite connectors are fitted into adjacent holes in a circuit board, the positions of the bifurcated contacts of each composite connector are such that a length of insulated conductor introduced between the limbs of the bifurcated contacts of the composite connector will extend between neighbouring composite connectors with negligible risk of rendering difficult connection of a length of insulated conductor to a neighbouring composite connector.

2. A bandoleer of composite connectors as claimed in claim 1, wherein the distance between the longitudinal axes of adjacent composite connectors of the bandoleer is approximately 5.08 mm (0.2 inch).

3. A bandoleer of composite connectors as claimed in claim 1 or 2, wherein the fracturable link is so inclined to the plane of the elongate strip that the common axis of the slots bounded by the limbs of the bifurcated contacts of each composite connector lies at an acute angle to the longitudinal axis of the strip lying in the range 60° to 65°.

4. A bandoleer of composite connectors as claimed in claim 1, wherein each fracturable link joins the tubular end portion of its associated composite connector at a position between the bifurcated contacts and substantially diametrically opposite the longitudinally extending free edges of the preform of which the composite connector is formed.

5. A bandoleer of composite connectors as claimed in claim 1 or 4, wherein each fracturable link is of approximately Z- or S- shape and is designed to fracture at a position immediately adjacent the tubular end portion of its associated composite connector.

6. A bandoleer of composite connectors as claimed in claim 1, wherein, for resiliently gripping a terminal pin of a circuit component, the socket of each composite connector has fitted therein a separately formed socket contact means of a metal or metal alloy of high electrical conductivity.

7. A bandoleer of composite connectors as claimed in claim 6, wherein the contact means of the socket of each composite connector includes a pair of substantially diametrically opposed substantially flat contact surfaces which lie in planes that are substantially parallel to the major surfaces of the strip.

8. A bandoleer of composite connectors as claimed in claim 6, wherein the contact means of the socket of each composite connector includes a pair of substantially diametrically opposed substantially flat contact surfaces which lie in planes that are substantially parallel to the major surfaces of the strip and also includes a second pair of substantially diametrically opposed substantially flat contact surfaces which are substantially normal to the first pair of diametrically opposed flat contact surfaces.

9. A bandoleer of composite connectors as claimed in claim 1, wherein the opposed faces of the limbs of each bifurcated contact of each composite connector over at least a part of their lengths near the closed end of the slot bounded by the limbs and over at least a part of their widths are substantially flat and lie substantially parallel to the plane common to the axes of the bifurcated contacts and of the composite connector.

10. A bandoleer of composite connectors as claimed in claim 1, wherein the radially inner and outer surfaces of the limbs of the bifurcated contacts of each composite connector are substantially flat and lie in planes substantially normal to the plane common to the axes of the bifurcated contacts and of the composite connector.

* * * * *